US005302094A

United States Patent [19]

Schlecht et al.

[11] Patent Number: 5,302,094

[45] Date of Patent: Apr. 12, 1994

[54] TUBE SWITCH FOR A DOUBLE-CYLINDER SLUDGE PUMP

[75] Inventors: Karl Schlecht; Hartmut Benckert, both of Filderstadt, Fed. Rep. of Germany

[73] Assignee: Putzmeister-Werk Maschinenfabrik GmbH, Aichtal, Fed. Rep. of Germany

[21] Appl. No.: 940,557

[22] Filed: Sep. 4, 1992

Related U.S. Application Data

[63] Continuation-in-part of Ser. No. 935,063, Aug. 25, 1992, abandoned, which is a continuation-in-part of Ser. No. 640,397, Jan. 18, 1991, abandoned.

[30] Foreign Application Priority Data

Jul. 19, 1988 [DE] Fed. Rep. of Germany ..... 3824466

[51] Int. Cl.[5] ..... F04B 15/02

[52] U.S. Cl. ..... 417/517; 417/512; 417/519; 417/532; 417/900

[58] Field of Search ..... 417/512, 517, 519, 532, 417/900

[56] References Cited

U.S. PATENT DOCUMENTS

| | | | |
|---|---|---|---|
| 3,963,385 | 6/1976 | Caban | 417/519 |
| 4,019,839 | 4/1977 | Schwing | 417/517 |
| 4,178,142 | 12/1979 | Schwing | 417/532 |
| 4,198,193 | 4/1980 | Westerlund et al. | 417/517 |
| 4,373,875 | 2/1983 | Schwing | 417/517 |
| 4,382,752 | 5/1983 | Schlecht | 417/519 |
| 4,465,441 | 8/1984 | Schwing | 417/517 |
| 4,613,290 | 9/1986 | Evenson | 417/532 |
| 4,614,483 | 9/1986 | Hudelmaier | 417/532 |
| 4,653,990 | 3/1987 | Schlecht | 417/532 |
| 4,979,884 | 12/1990 | Letarte et al. | 417/532 |
| 5,037,275 | 8/1991 | Schlecht | 417/900 |

FOREIGN PATENT DOCUMENTS

| | | |
|---|---|---|
| 0057288 | 8/1982 | European Pat. Off. . |
| 2921735 | 12/1980 | Fed. Rep. of Germany . |

*Primary Examiner*—Richard A. Bertsch
*Assistant Examiner*—Peter Korytnyk
*Attorney, Agent, or Firm*—Kenyon & Kenyon

[57] ABSTRACT

A tube switch for a double-cylinder sludge pump is provided including a swing pipe, a wearing ring and an elastic member. The swing pipe is adapted to swivel in front of a center plate and includes an extension portion having an inner surface. The wearing ring is supported between the end of the swing pipe and the center plate and is axially movable relative to the swing pipe. The wearing ring has a recess formed at one end thereof, defined by a sloped boundary surface. The swing pipe is adapted to receive the end of the wearing ring including the recess therein. The recess thus defines an annular space between the swing pipe and the wearing ring with the inner surface of the extension portion of the swing pipe facing the annular space. The elastic member includes a radial inner surface and a sloped front end surface that corresponds to the boundary surface of the wearing ring. The elastic member is supported between the swing pipe and the wearing ring within the annular space. The front end surface of the elastic member abuts the boundary surface of the wearing ring. The inner surface of the extension portion of the swing pipe is ridgeless such that generally no portion of the swing pipe contacts the radial inner portion of the elastic member.

48 Claims, 4 Drawing Sheets

TUBE SWITCH FOR A DOUBLE-CYLINDER SLUDGE PUMP

RELATED APPLICATIONS

This application is a continuation in part application of U.S. patent application Ser. No. 07/935,063, now abandoned filed Aug. 25, 1992 and entitled TUBE SWITCH FOR A DOUBLE-CYLINDER SLUDGE PUMP, which is in turn a continuation in part application U.S. patent application Ser. No. 07/640,397, filed Jan. 18, 1991 and entitled TUBE SWITCH FOR A DOUBLE-CYLINDER SLUDGE PUMP.

The present invention relates to a tube switch for a double-cylinder thick matter pump including a swing pipe adapted to swivel in front of a center-rest plate on the cylinder inside of the tube switch. A wearing ring is mounted so that it is axially movable on the center-rest plate end of the swing pipe and is adapted to be pressed against the center-rest plate with the aid of the hydrostatic internal pressure in the swing pipe. A rubber elastic ring is mounted between the swing pipe and the wearing ring.

The wearing ring includes an axial guide surface on the end thereof adjacent to the swing pipe. The guide surface is supported on a cylindrical centering surface of the swing pipe, which points radially to the outside. Together with the centering surface, the axial guide defines a sealing gap. The wearing ring includes a ring extension on its end adjacent to the center-rest plate. The ring extension is directed radially inwardly from the axial guide surface, and includes a front outer surface which abuts the center-rest plate, and an inner surface which serves as an axial abutment for the rubber elastic ring. The inner surface is separated from the end face of the swing pipe by an axial clearance space bridged by the rubber elastic ring and open toward the inside of the pipe. The swing pipe includes a recess formed in the front end thereof. The recess preferably has a rectangular shape, and is open toward the axial guide surface and extends under the sealing ring on the inside thereof.

Tube switches of the type carrying an automatic, hydrostatically adjusting wearing ring, typically referred to as an automatic ring, are shown, for example, in German Patent No. 26 14 895 and German Published Patent No. 31 03 321. In German Patent No. 31 03 321, ring recesses which accommodate the rubber elastic ring, are provided in both the swing pipe and the wearing ring. The recesses face each other and extend under the ends of the rubber elastic ring.

One problem is that abrasive material can penetrate into the area of the ring recesses and behind the rubber elastic ring. On the side of the swing pipe, the abrasive material can penetrate the radial gap between the wearing ring and the swing pipe and emerge through the radial gap to the outside, whereas, the abrasive material penetrating the eccentric relief between the wearing ring and the sealing ring typically cannot pass into the pipe when the pressure is relieved. The latter situation leads to an axial bracing of the tube switch, thus making switch-through operation of the tube switch tight and, in turn, promoting wear.

Additionally, the eccentric relief is gradually filled with hardened abrasive material and, as result, with increasing wear and the increasing axial air, the flexible sealing ring can be pulled toward the inside of the pipe and, in turn, become lost. This problem occurs particularly when the sludge pump draws a vacuum during reverse delivery. Due to the effect of the hardened material penetrating to the outside, the relative axial movement between the swing pipe and wearing pipe, which occurs particularly during delivery under high pressure, untimely leads to rapid wear and tear. With cyclically increasing pressure, this relative axial movement is typically within the range of about 1 to 3 mm, depending on the elasticity of the pump housing.

Starting from this point, an underlying task of the present invention is to create a tube switch for double-cylinder sludge pumps, which reliably prevents the outflow of abrasive material and, in turn, facilitates low wear axial guidance between the wearing ring and the tube switch.

To solve this task, the characteristics recited in claim 1 are proposed. Advantageous refinements and further developments of the inventive features of the present invention are recited in the dependent claims.

In practical operation, it is particularly important when the tube switch is switched through and when solid particles, such as stones and the like, become lodged between the wearing ring and center rest, that the wearing ring be able to spring back somewhat and, in addition, be able to tilt easily in both the axial and radial directions. Furthermore, it must be ensured, to the greatest extent possible, that the abrasive material does not reach the sealing gap and, in turn, become deposited in the vicinity of the sealing ring, where it typically then hardens and gradually increases in quantity.

To achieve these advantages, in the apparatus of the present invention, the inner surface of the ring extension, which is premolded on the wearing ring in this area, serves as an axial abutment for the rubber elastic ring, and is ridgeless toward the inside of the swing pipe. The recess in the swing pipe extends under the rubber elastic ring over at least one third, and preferably more than one half and, in some instances, two thirds of its axial length.

In order to carry out an axial guidance function, the radial outer surface of the rubber elastic ring abuts the portion of the axial guide surface of the wearing ring that bridges the recess. The front end face of the rubber elastic ring abuts the axial inner surf ace of the ring extension supported in the wearing ring. The rubber elastic ring is also braced by its radial inner surf ace, which bridges the front clearance space between the swing pipe and the ring extension and is seated against the radial boundary surf ace of the recess. The elastic ring is also braced by its rear end face against the axial boundary surface of the recess of the swing pipe.

When pressurized, the apparatus of the present invention causes the delivered material, which comes from inside the pipe and reaches the clearance space and, in turn, tends to harden, to be pressed under pressure-flexible deformation into the rubber elastic ring in the vicinity of its front end on the side of the center rest. As a result, the rear part of the elastic ring is firmly forced against the sealing gap in the vicinity of the axial guidance surface between the wearing ring and the swing pipe. Thus, even if the material hardens, the tube switch can spring back toward the center-rest plate when pressure is released, because of the elastic deformation of the elastic ring.

To ensure that the elastic ring has sufficient capacity for deformation, a gap is maintained between the front end of the swing pipe and the opposing inner surface of the ring extension on the wearing ring. Preferably, to improve the access of the delivered material to the hydrostatically sealing elastic ring, the apparatus of the present invention includes radially traversing, axially open slots, preferably about 1 to 2 mm deep, located on the front end of the swing pipe.

Another feature of the present invention for achieving the spring back action as described above, and thus the passage of delivered material for purposes of hydrostatic bearing pressure, is to form chamfers facing the inside of the pipe or, preferably, wedge-shaped circumferential grooves on the elastic ring. When the chamfers or circumferential grooves are provided on both ends of the elastic sealing ring, the ring can be installed without regard to the direction in which it is facing and, in turn, flipped around when one side becomes worn. Accordingly, it is possible to double the lifetime of the ring. Moreover, the two-sided chamfering correspondingly increases the spring back volume of the ring.

In order to prevent the elastic ring from being pressed too far and with too much force when there is a somewhat larger gap between the wearing ring and the swing pipe, and when the tube switch is mechanically adjusted, the swing pipe preferably includes a stepped stop for the wearing ring in the vicinity of the rear end of the cylindrical axial guide surface. The stepped stop facilitates maintaining the gap open, even when the wearing ring is struck.

In order to achieve a reliable axial seal, and to improve the axial seal for certain types of material being delivered, a recessed circumferential groove is preferably formed in the axial guide surface of the wearing ring opposite the swing pipe, or in the axial guide surface of the swing pipe opposite the wearing ring. The circumferential groove is adapted to receive an o-ring which, accordingly, improves the axial seal.

Preferably and advantageously, the diameter of the axial guide surface of the wearing ring is larger than the effective diameter, or even larger that the front, outside diameter of the ring extension, which the wearing ring abuts on the center-rest plate. It is particularly advantageous for the surfaces of the wearing ring that are pressurized with hydrostatic pressure to be dimensioned so that the effective diameter of the force transmitted between the tube switch and the wearing ring in the direction of the contact pressure, be larger than the effective diameter of the force transmitted between the center-rest plate and the wearing ring in the lift-off direction.

BRIEF DESCRIPTION OF THE DRAWINGS

The present invention is hereinafter described in greater detail with reference to the following embodiments illustrated in the drawings. The following figures are illustrated.

DETAILED DESCRIPTION

Figure 1A:
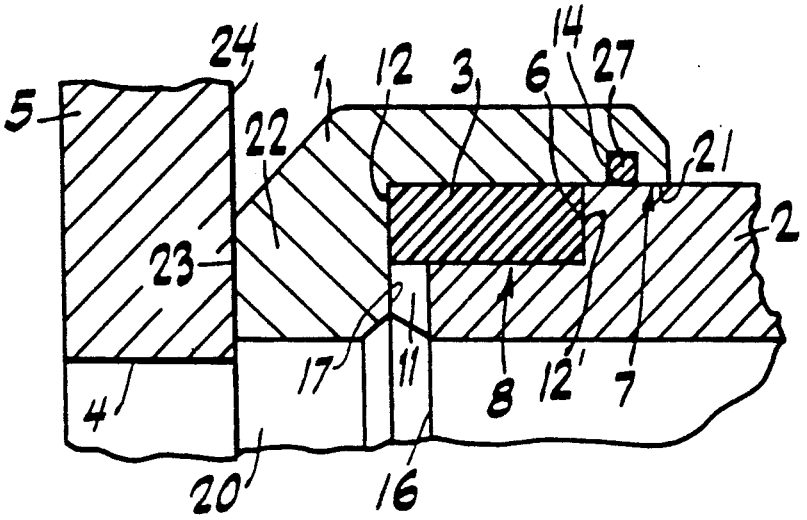
FIG. 1*a* is a partial longitudinal-sectional view of the cylinder-side of a tube switch of a double-cylinder sludge pump embodying the present invention.

In the drawings a portion of a tube switch embodying the present invention is illustrated. The tube switch is used with a double-cylinder sludge pump, including discharge cylinders (not shown), in which the orifices on the side of a material feed tank (not shown) are covered by an interchangeable center-rest plate 5. On the side of the material feed tank, a swing pipe 2 is supported with its front end in front of the center-rest plate 5. The swing pipe 2 is adapted to swivel back and forth about a horizontal axis, so that its orifice 20 appears alternately in front of one or the other of the two orifices 4 (only one shown) and provides for communicating connection of the other or the one orifice, respectively with the material feed tank. At its end opposite the center-rest plate 5, the swing pipe 2 leads into a delivery pipe (not shown).

In order to connect the swing pipe 2 on the front side thereof to the center-rest plate 5 in a pressure-tight manner, a wearing ring 1 is supported therebetween. The wearing ring I includes a cylindrical axial guide surface 21, which is axially movable relative to a cylindrical guide and centering surface 7 of the swing pipe 2. On its front end, the wearing ring 1 includes a ring extension 22 which is directed radially toward the inside of the tube switch. An outer frontal contact surface 23 of the ring extension 22 abuts a contact surface 24 of the center-rest plate 5, and a ring-shaped inner surface 17 is located opposite a frontal area 16 of the swing pipe 2.

A rectangular stepped recess 6 is formed in the front end of the swing pipe 2. The stepped recess 6 thus forms a radial boundary surface 8, which has a diameter less than the diameter of the surface 7. Thus, as can be seen, an annular space having a rectangular cross-section is formed between the front end of the swing pipe 2 and the adjacent inner surf aces of the wearing ring 1. A rubber elastic ring 3 is supported within the annular space and maintained under an initial stress. The radial inner surface of the ring 3 abuts the radial boundary surface 8; the rear end face 121 of the ring 3 abuts the axial step 6 of the recess in the tube switch 2; the outer surface of the ring 3 abuts that part of the axial guide surface 21 of the wearing ring 1, which is bridging the recess; and the front end face 12 of the ring 3 abuts the radial external portion of the inner ring surface 17 of the wearing ring 1.

The end face 16 of the swing pipe 2 is separated from the inner surface 17 of the wearing ring 1 by a radially traversing, axially open slot 11, as shown in FIG. 1*a*, or by a ring gap 18, as shown in FIGS. 2*a* and 2*b*. Accordingly, the viscous material conveyed under pressure through the swing pipe 2 can move from the inside thereof into contact with the portion of the elastic ring 3 bridging the slot 11, or the gap 18, respectively.

Figure 2:
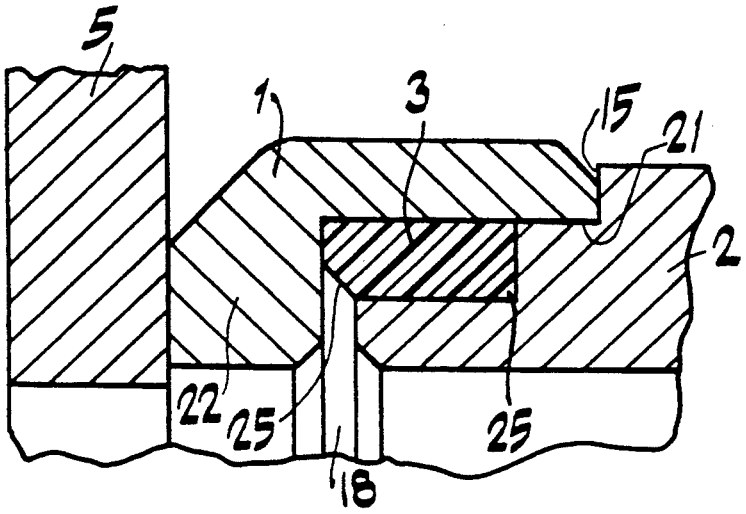
FIG. 2 is a longitudinal-sectional view of a modified embodiment of the tube switch of the present invention in a representation corresponding to that of FIG. 1*a*.
Figure 3:
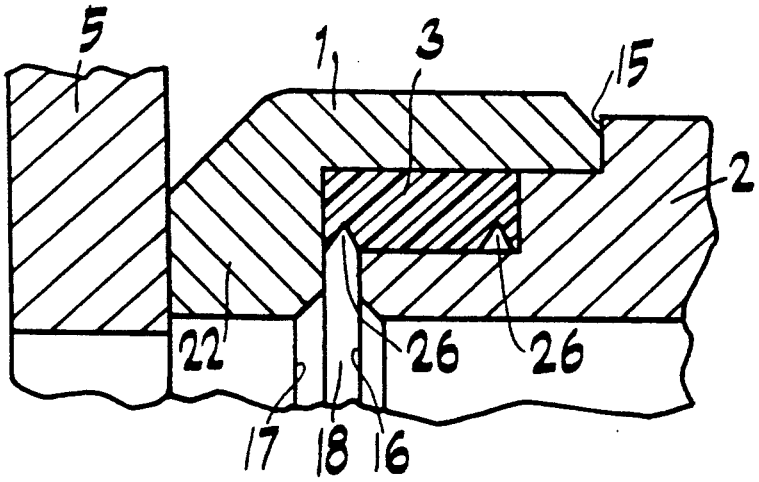
FIG. 3 is longitudinal-sectional view of another modified embodiment of the tube switch of the present invention in a representation corresponding to that of FIG. 2.

In the embodiment of FIG. 1*a*, the top edges of the slots 11 are striking the inner surface 17 of the wearing ring 1. In the embodiments of FIGS. 2 and 3, on the other hand, a step 15 is formed in a rearward portion of the swing pipe 2 as a boundary stop for the wearing ring 1. When pressurized, the conveyed viscous material is pressed through the slot 11 or the ring gap 18, respectively, against the rubber elastic ring 3. As a result of the pressure against the ring 3, the ring 3 seals the gap between the wearing ring 1 and swing pipe 2.

In order to improve the spring-back properties of the ring 3, chamfers 25, as shown in FIG. 2, or wedge-shaped circumferential grooves 26, as shown in FIG. 3, are formed on the inner side of the ring 3 on either end thereof. By forming the chamfers 25 or circumferential grooves 26 on either end of the ring 3, on the one hand, the spring-back volume of the elastic ring 3 is increased and, on the other hand, the ring 3 can be flipped over when one side becomes worn out to thus double the life expectancy of the ring. In order to improve the axial seal in the embodiment of FIG. 1*a*, a circumferential groove 14 is formed in the rear end of the wearing ring 1 and is adapted to receive an o-ring 27.

In addition to a sealing function, the rubber elastic ring 3, with its essentially rectangular cross-section, also assumes on the basis of its initial stress the function of automatically adjusting the wearing ring 1 in case of wear. Moreover, the radial outer surface of ring 3 acts as an extension of the axial guide and centering surface 21. As shown in FIGS. 1*a* through 3, the axial length of the ring 3 is equal to at least twice, and preferably several times the axial length of the guide and centering surface 21 in contact with, or overlapping the swing pipe 2. As a result, it is possible for the wearing ring 1 to tilt relatively easily in the vicinity of the centering surface 21 due to the clearance, which necessarily must be available, between the wearing ring 1 and the swing pipe 2 and because of the elastic properties of the ring 3 if solid particles are forced into the gap between the contact surfaces 23 and 24 of the wearing ring 1 and the center-rest plate 5, respectively. As a result, wear and tear in such situations is considerably reduced and, accordingly, the life expectancy of the wearing ring 1 and the center-rest plate 5 is correspondingly increased.

Figure 1B:
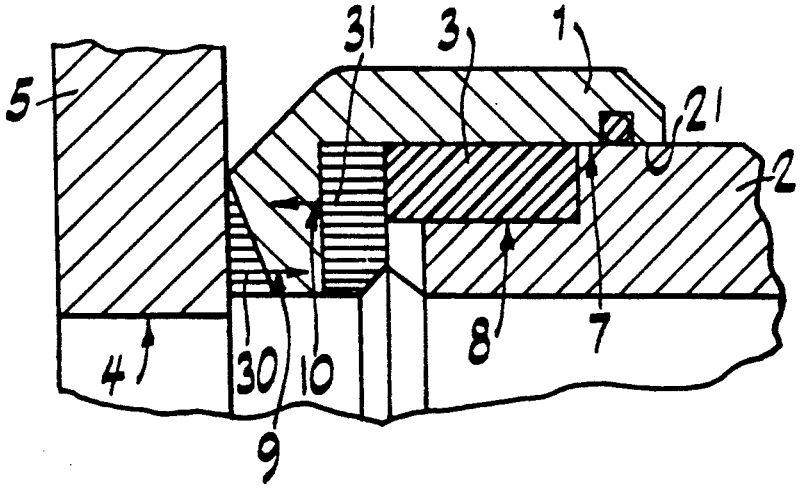
FIG. 1*b* is a schematic illustration of the forces acting under the effect of hydrostatic pressure on the wearing ring of the embodiment of the present invention shown in FIG. 1*a*.

As illustrated in FIG. 1*b*, the ring surfaces 23 and 17 of the wearing ring 1, which are pressurized by hydrostatic pressure, are configured and designed so that the force 31 acting in the direction of the contact pressure is greater than the lift-off force 30 tending to push the wearing ring 1 away from the plate 5. In addition, as illustrated in FIG. 1*b*, the effective diameter 10 of the force 31 acting between the swing pipe 2 and the wearing ring 1 in the direction of the contact pressure, is larger than the effective diameter 9 of the force 30 acting between the center-rest plate 5 and the wearing ring 1 in the lift-off direction. Furthermore, the diameter of the axial guide and centering surface 7 of the wearing ring 1 is larger than the effective diameter 9 of the force 30 transmitted between the wearing ring 1 and the center-rest plate 5. The diameter of the surface 7 is also larger than the front outside diameter of the ring extension 22 i.e., the outer diameter of the contact surface 23 with which the wearing ring I abuts the center-rest plate 5, as shown in FIGS. 1*a* through 3.

Figure 4A:
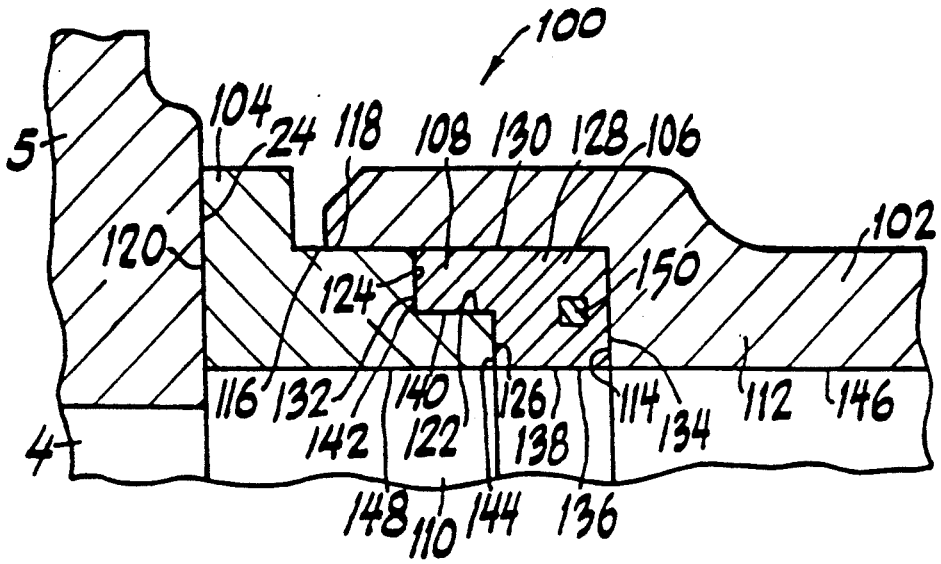
FIGS. 4*a* and 4*b* are partial longitudinal-sectional views of a tube switch in accordance with an alternative embodiment of the invention.
Figure 4B:
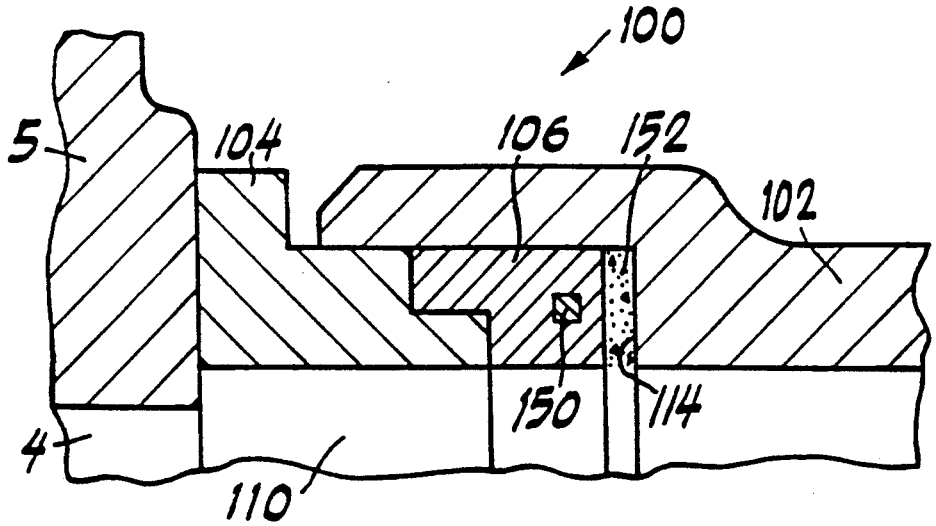

FIGS. 4*a* and 4*b* illustrate a portion of a tube switch 100 in accordance with an alternative embodiment of the invention. In this embodiment, a swing pipe 102 is adapted to receive a wearing ring 104. Also, an elastic member or elastic ring 106 is positioned in a stepped recess 108 formed on the wearing ring 104 rather than on the swing pipe 102.

As with the tube switches previously described, the tube switch 100 is usable with a double cylinder sludge pump having discharge cylinders (not shown), in which the orifices on the side of a material feed tank (not shown) are covered by the interchangeable center-rest plate 5. The swing pipe 102 is supported with its front end in front of the center-rest plate 5. The swing pipe 104 includes a bore 110 extending therethrough and is adapted to swivel back and forth about a horizontal axis, so that the bore 110 appears alternately in front of and is in communication with one or the other of the two orifices 4 (only one shown) in the center rest plate 5. At its end opposite the center-rest plate 5, the swing pipe 102 leads into a delivery pipe (not shown). The swing pipe 102 also comprises an extension portion 112 with an inner surface 114 facing the recess 108.

The wearing ring 104 is supported between the swing pipe 102 and the center rest plate 5 to connect the swing pipe 102 to the center-rest plate 5 in a pressure-tight manner. The swing pipe 102 includes a cylindrical axial guide surface 116 that is adapted to receive and is axially movable relative to a cylindrical guide and centering surface 118 on the wearing ring 104. On its front end, the wearing ring 104 includes an outer frontal contact surface 120 that abuts the contact surface 24 of the center rest plate 5.

The stepped recess 108 is formed in a rear portion of the wearing ring 104. The stepped recess 108 is defined by a radial boundary surface 122 and a pair of axial step surfaces 124, 126. An annular space 128 is thereby formed between the swing pipe 102 and the wearing ring 104, defined by the stepped recess 108 in the wearing ring 104 and the cylindrical axial guide surface 116 and the inner surface 114 of the swing pipe 102.

The elastic ring 106 is positioned in the annular space 128 and maintained under an initial stress. The ring 106 includes an outer surface 130, front and back ends 132, 134 and a radial inner portion 136. The radial inner portion 136 comprises a pair of stepped radial inner surfaces 138, 140. The front end 132 comprises a pair of stepped front end surfaces 142, 144.

When positioned in the annular space 128, the radial inner surface 140 of the elastic ring 106 abuts the radial boundary surface 122 of the wearing ring 104. Also, the front end surfaces 142, 144 of the elastic ring 106 abut the axial step surfaces 124, 126, respectively of the wearing ring 104. In addition, the back end 134 of the elastic ring 106 abuts the inner surface 114 of the swing pipe 102 and the outer surface 130 of the elastic ring 106 abuts that part of the axial guide surface 116 of the swing pipe 102 that bridges the annular space 128. Also, the radial inner surface 138 of the elastic ring 106 is generally in alignment with the inner radial surfaces 146 and 148 of the swing pipe 102 and the wearing ring 104, respectively facing the bore 110.

Preferably, at least one third of the axial length of the radial inner portion 136 of the elastic ring 106 is seated on the radial boundary surface 122 of the wearing ring 104. Also, the extension portion 112 of the swing pipe 102 is ridgeless such that generally no portion of the swing pipe 102 contacts the radial inner portion 136 of the elastic ring 106.

The stepped recess and stepped elastic ring arrangement improves the seal between the wearing ring 104 and the swing pipe 102 by increasing the abutting surface area of the elastic ring 106.

A reinforcing ring 150 may be positioned in the elastic ring 106 proximate the extension portion 112 of the swing pipe 102. The reinforcing ring 150 acts to prevent the elastic ring 106 from being drawn out of the annular space 128 into the bore 110. The reinforcing ring 150 is preferably made of metal.

As shown in FIG. 4*b*, when the tube switch 100 is in use, concrete, mortar or other materials 152 flowing through the bore 110 may be forced between the back end 134 of the elastic ring 106 and the inner surface 114 of the swing pipe 102. The presence of the materials 152 will cause axial movement and further compression of the elastic ring 106. Thus, only limited pretension of the elastic ring 106 is required during assembly of the tube switch 100.

Figure 5:
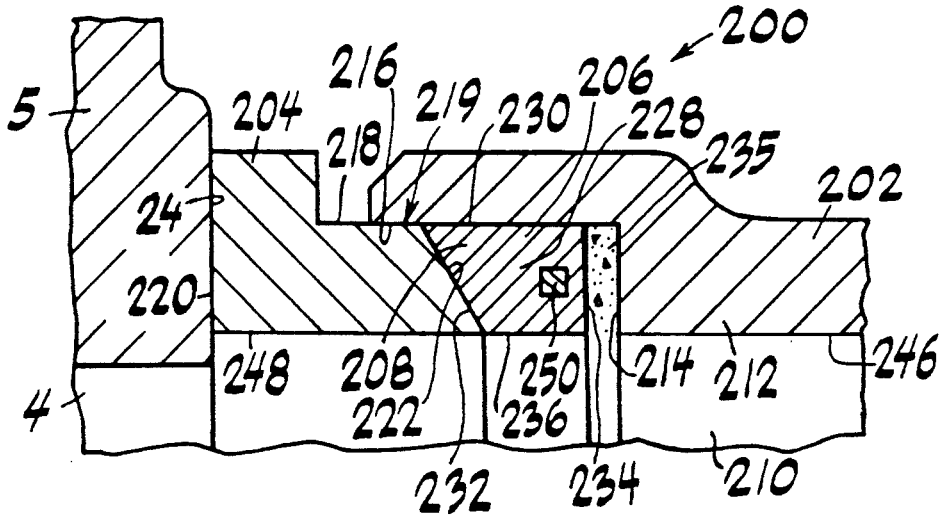
FIG. 5 is a partial longitudinal-sectional view of a tube switch in accordance with a further embodiment of the invention.

FIG. 5 illustrates a portion of a tube switch 200 in accordance with a further embodiment of the invention. The tube switch 200 includes a swing pipe 202, which is adapted to receive a wearing ring 204. Also, an elastic member or elastic ring 206 is partly positioned in a recess 208 formed in the wearing ring 204.

As with the tube switches previously described, the tube switch 200 is usable with a double cylinder sludge pump having discharge cylinders (not shown), in which the orifices on the side of a material feed tank (not shown) are covered by the interchangeable center-rest plate 5. The swing pipe 202 is supported with its front end in front of the center rest plate or center plate 5. The swing pipe 202 includes a bore 210 extending therethrough and is adapted to swivel back and forth about a horizontal axis, so that the bore 210 appears alternately in front of and is in communication with one or the other of the two orifices 4 (only one shown) in the center rest plate 5. At its end opposite the center-rest plate 5, the swing pipe 202 leads into a delivery pipe (not shown). The swing pipe 202 also comprises an extension portion 212 with an inner surface 214 facing the recess 208.

The wearing ring 204 is supported between the swing pipe 202 and the center rest plate 5 to connect the swing pipe 202 to the center rest plate 5 in a pressure-tight manner. The swing pipe 202 includes a cylindrical axial guide surface 216 that is adapted to receive a cylindrical guide and centering surface 218 on the wearing ring 204. The cylindrical axial guide surface 216 is axially and rotatably movable relative to a cylindrical guide and centering surface 218. A radial gap 219 is present between the cylindrical axial guide surface 216 and the cylindrical guide and centering surface 218.

On its front end, the wearing ring 204 includes an outer frontal contact surface 220 that abuts the contact surface 24 of the center rest plate 5.

The recess 208 is formed in a rear portion of the wearing ring 204 and is defined by a sloped boundary surface 222, which is inclined relative to the cylindrical guide and centering surface 218 and the radial gap 219. An annular space 228 is thereby formed between the swing pipe 202 and the wearing ring 204, defined by the recess 208 in the wearing ring 204 and the cylindrical axial guide surface 216 and the inner surface 214 of the swing pipe 202.

The elastic ring 206 is positioned in the annular space 228. The ring 206 includes an outer surface 230, front and back end surfaces 232, 234 and a radial inner surface 236. The front end surface 232 is inclined and corresponds to the sloped boundary surface 222 of the wearing ring 204.

When the elastic ring 206 is positioned in the annular space 228, the front end surface 232 of the elastic ring 206 abuts the sloped boundary surface 222 of the wearing ring 204. Also, the outer surface 230 of the elastic ring 206 abuts that part of the cylindrical axial guide surface 216 of the swing pipe 202 that bridges the annular space 228. In addition, the back end surface 234 of the elastic ring 206 abuts the inner surface 214 of the swing pipe 202. However, as shown in FIG. 5 concrete or other materials 235 flowing through the swing pipe 202 can move between the inner surface 214 of the swing pipe 202 and the back end surface 234 of the elastic ring 206.

The radial inner surface 236 of the elastic ring 206 is generally aligned with the inner radial surfaces 246 and 248 of the swing pipe 202 and the wearing ring 204, respectively, facing the bore 210. Preferably, the extension portion 212 of the swing pipe 202 is ridgeless such that generally no portion of the swing pipe 202 contacts the radial inner surface 236 of the elastic ring 206.

As shown in FIG. 5, when the tube switch 200 is in use, material like concrete or mortar 235 flowing through the bore 210 can be forced between the back end surface 234 of the elastic ring 206 and the inner surface 214 of the swing pipe 202. Concrete can also initially move between the boundary surface 222 of the wearing ring 204 and the front end surface 232 of the elastic ring 206. However, since the pressure outside of the tube switch 200 will be lower than the pressure of the concrete flowing through the swing pipe 202, the concrete will initially flow freely between the front end surface 232 and the boundary surface 222 to the radial gap 219 between the wearing ring 204 and the swing pipe 202 and then to the outside of the tube switch 200. At the same time, however, concrete flowing between the back end surface 234 of the elastic ring 206 and the inner surface 214 of the swing pipe 202 will accumulate therebetween, thereby forcing the front end surface 232 of the elastic ring 206 to be pressed against the boundary surface 222 of the wearing ring 204 to effectively seal the radial gap 219 from flow therethrough. Preferably, the accumulated concrete 235 between the back end surface 234 of the elastic ring 206 and the inner surface 214 of the swing pipe 202 will harden to constantly force the front end face 232 against the boundary surface 222.

The presence of the concrete 235 will cause compression of the elastic ring 206 and have the advantageous effect of dampening the normal telescoping movement made by the wearing ring 204 relative to the swing pipe 202.

Telescoping movement of the wearing ring 204 occurs as a result of pulsations caused by the pumping process.

The radial gap 219 between the swing pipe 202 and the wearing ring 204 may have a width of approximately 1 mm to enable the wearing ring 204 to effectively rotate about the axis of the swing pipe 202. With this arrangement, the wear between the parts caused by dried concrete therebetween is reduced as the concrete can be distributed around the circumference of the wearing ring 204.

To enable proper rotation of the wearing ring 204 relative to the swing pipe 202, it is preferable to insert the elastic ring 206 between the wearing ring 204 and the swing pipe 202 with little or no pretension.

A reinforcing ring 250 may be inserted or vulcanized in the elastic ring 206 proximate the extension portion 212 of the swing pipe 202. The reinforcing ring 250 acts to prevent the elastic ring 206 from being drawn out of the annular space 228 into the bore 210 during the telescoping movement of the wearing ring 204 relative to the swing pipe 202. The reinforcing ring 250 is preferably made of metal.

We claim:

1. A tube switch for a double-cylinder sludge pump, comprising:

a swing pipe adapted to swivel in f ront of a center plate, the swing pipe including a cylindrical axial guide surface at one end thereof, the swing pipe also including an extension portion having an inner surface;

a wearing ring supported between the end of the swing pipe and the center plate and axially movable relative to the swing pipe, the wearing ring including a recess at one end thereof, the recess having a radial boundary surface and an axial step surface, the cylindrical axial guide surface of said swing pipe being adapted to receive the end of the wearing ring including the recess therein, the recess thus defining an annular space between the swing pipe and the wearing ring, the wearing ring including an outer frontal contact surface at the other end thereof being adapted to be pressed against the center plate in response to pressure within the swing pipe, the inner surface of the extension portion of the swing pipe facing the annular space; and a elastic member including a radial inner portion and front and back ends, the elastic member supported between the swing pipe and the wearing ring within the annular space defined by the recess, wherein the radial inner portion of the elastic member abuts the radial boundary surface of the wearing ring, the front end of the elastic member abuts the axial step of the wearing ring, and the back end of the elastic member abuts the inner surface of the swing pipe, and wherein at least one third of the axial length of the radial inner portion of the elastic member is seated on the radial boundary surface, and wherein the inner surface of the extension portion of the swing pipe is ridgeless such that generally no portion of the swing pipe contacts the radial inner portion of the elastic member, the elastic member thus being adapted to seal the space between the wearing ring and the swing pipe.

2. A tube switch as defined in claim 1, further comprising a reinforcing ring positioned within said elastic member.

3. A tube switch as defined in claim 2, wherein said reinforcing ring comprises metal.

4. A tube switch as defined in claim 1, wherein the radial inner portion of the elastic member comprises stepped surfaces.

5. A tube switch as defined in claim 4, wherein one of the stepped surfaces of the elastic member is seated on the radial boundary surface of the wearing ring.

6. A tube switch as defined in claim 1, wherein the recess in the wearing ring includes two axial step surfaces and wherein the front end of the elastic member comprises two stepped surfaces corresponding to and abutting the two axial step surfaces to increase the abutting surface area of the elastic member.

7. A tube switch as defined in claim 1, wherein the the swing pipe includes a bore extending therethrough and wherein the wearing ring and the swing pipe each include a radial inner surface facing the bore and wherein a part of the radial inner portion of the elastic member faces the bore and is generally aligned with the radial inner surfaces of the wearing ring and the swing pipe.

8. A tube switch for a double-cylinder sludge pump, comprising:

a swing pipe adapted to swivel in f ront of a center plate, the swing pipe including a recess at one end thereof, the recess having a radial boundary surface and an axial step surface;

a wearing ring supported between the end of the swing pipe and the center plate and axially movable relative to the swing pipe, the wearing ring including a cylindrical axial guide surface at one end thereof adapted to receive the end of the swing pipe including the recess therein, the recess thus defining an annular space between the swing pipe and the wearing ring, the wearing ring including an outer frontal contact surface at the other end thereof being adapted to be pressed against the center plate in response to pressure within the swing pipe, the wearing ring also including a ring extension including an inner surface facing the annular space; and an elastic member including a radial inner surface and front and back end faces, the elastic member supported between the swing pipe and the wearing ring within the annular space defined by the recess, wherein the radial inner surface of the elastic member abuts the radial boundary surface of the swing pipe, the front end of the elastic member abuts the inner surface of the ring extension, and the back end of the elastic member abuts the axial step surface of the swing pipe, and wherein at least one third of the axial length of the radial inner surface of the elastic member is seated on the radial boundary surface, and wherein the inner surface of the ring extension is ridgeless such that generally no portion of the wearing ring contacts the radial inner surface of the elastic member, the elastic member thus being adapted to seal the space between the wearing ring and the swing pipe.

9. A tube switch as defined in claim 8, wherein at least one half of the axial length of the radial inner surface of the elastic member is seated on the radial boundary surface of the swing pipe.

10. A tube switch as defined in claim 8 wherein at least two thirds of the axial length of the radial inner surface of the elastic member is seated on the radial boundary surface of the swing pipe.

11. A tube switch as defined in claim 8, wherein the recess is formed in the edge of the swing pipe on the end thereof, and the outer edge of the recess is adapted to abut the wearing ring.

12. A tube switch as defined in claim 8, wherein the swing pipe further defines a step axially spaced away from the recess and projecting outwardly therefrom, the step being adapted to abut the wearing ring upon the wearing ring being moved toward the swing pipe to, in turn, prevent the edge of the swing pipe adjacent to the recess from contacting the wearing ring.

13. A tube switch as defined in claim 8, wherein the wearing ring includes a circumferential groove formed in an interior surface thereof and facing the swing pipe, the circumferential groove being adapted to receive an o-ring therein, the o-ring thus forming a seal between the wearing ring and the swing pipe.

14. A tube switch as defined in claim 8, wherein the diameter of the guide surface is greater than the effective diameter of the outer frontal contact surface of the wearing ring upon abutting the center plate.

15. A tube switch as defined in claim 8, wherein the diameter of the guide surface is greater than the outside diameter of the outer frontal contact surface of the wearing ring.

16. A tube switch as defined in claim 8, wherein the inner surface of the wearing ring is oriented in a plane substantially parallel to the plane of the outer frontal contact surface and axially spaced therefrom, whereupon the elastic member and the end of the swing pipe are adapted to be pressed against the inner surface of the wearing ring in response to the presence of pressure within the swing pipe.

17. A tube switch as defined in claim 16, wherein the outer frontal contact surface and the inner surf ace of the wearing ring are dimensioned so that the effective diameter of the force transmitted between the swing pipe and the inner surface is greater than the effective diameter of the force transmitted between the outer frontal contact surface and the center plate upon the presence of pressure within the swing pipe.

18. A tube switch as defined in claim 8, wherein the axial length of the surface of the swing pipe in contact with the elastic member is at least two times greater than the axial length of the surf ace of the swing pipe in contact with the wearing ring.

19. A tube switch as defined in claim 8, wherein the elastic member includes a groove formed therein and extending beyond the end of the swing pipe, the groove being adapted to receive fluid and/or other material therein.

20. A tube switch as defined in claim 19, wherein the elastic member includes two grooves, each groove being formed on either end in the axial direction thereof.

21. A tube switch as defined in claim 19, wherein the groove is defined by a surface facing in a direction substantially away from the swing pipe, the groove thus being adapted to receive pressurized fluid and/or particles therein and, in turn, directing the force of the pressure to push the elastic member to form a seal between the wearing ring and the swing pipe.

22. A tube switch for a sludge pump, comprising:

a center plate supported adjacent to the cylinders of the sludge pump and defining an orifice extending therethrough and in fluid communication with at least one cylinder, the center plate further defining a contact surface extending around the orifice;

a wearing ring supported adjacent to the center plate and defining an opening extending therethrough in fluid communication with the orifice of the center plate, the wearing ring including an outer frontal contact surf ace on one end thereof being adapted to abut the contact surf ace of the center plate, the wearing ring further including a first annular guide surface at the other end thereof, the wearing ring further defining an inner surface oriented in substantially the same plane as the outer frontal contact surface and located adjacent to the interior end of the first annular guide surface;

a swing pipe having an opening extending therethrough and in fluid communication with the opening of the wearing ring, the swing pipe defining a second annular guide surface, one end of the second annular guide surface being adapted to be received within the first annular guide surface of the wearing ring and including a recess formed therein having a radial boundary surface and an axial step surface, the recess thus defining a space between the swing pipe and the first annular guide surface of the wearing ring; and an elastic member including a radial inner surface and front and back end faces, the elastic member being supported within the space defined by the recess, wherein the front end of the elastic member abuts the inner surface of the wearing ring, the back end of the elastic member abuts the axial step of the swing pipe and the radial inner surface of the elastic member abuts the radial boundary surface of the swing pipe, and wherein at least one third of the axial length of the radial inner surface of the elastic member is seated on the radial boundary surf ace, and wherein the inner surface of the wearing ring is ridgeless such that generally no portion of the wearing ring contacts the radial inner surf ace of the elastic member, the elastic member thus forming a seal between the first annular guide surface of the wearing ring and the swing pipe.

23. A tube switch as defined in claim 22, wherein the swing pipe further defines a step projecting outwardly from the second annular guide surface, the step being adapted to abut the end of the wearing ring to, in turn, prevent the end of the swing pipe f rom contacting the inner surface of the wearing ring.

24. A tube switch as defined in claim 22, wherein the wearing ring includes a circumferential groove formed in the first annular guide surface thereof and facing the second annular guide surface of the swing pipe, the circumferential groove being adapted to receive an o-ring therein to thus form a seal between the first and second annular guide surfaces.

25. A tube switch as defined in claim wherein the diameter of the second annular guide surf ace of the swing pipe is greater than the outer diameter of the outer frontal contact surface of the wearing ring.

26. A tube switch as defined in claim 22, wherein the outer frontal contact surface and the inner surf ace of the wearing ring are dimensioned so that the effective diameter of the force transmitted between the swing pipe and the inner surface is greater than the effective diameter of the force transmitted between the contact surface of the center plate and the outer frontal contact surface upon the presence of pressure within the swing pipe.

27. A tube switch as defined in claim 22, wherein the elastic member includes a groove formed therein and extending between the recess in the swing pipe and the inner surf ace of the wearing ring, the groove being adapted to receive pressurized fluid or other pressurized material therein from the swing pipe and, in turn, direct the force of the pressure to push the elastic member to facilitate forming a seal between the first and second annular guide surfaces.

28. A tube switch as defined in claim 27, wherein the elastic member includes two grooves, each groove being formed on either end in the axial direction thereof.

29. A tube switch for a double-cylinder sludge pump, comprising:

a swing pipe adapted to swivel in front of a center plate, the swing pipe including a recess formed in one end thereof;

a wearing ring supported between the end of the swing pipe and the center plate and axially movable relative to the swing pipe, the wearing ring including one end adapted to receive the end of the swing pipe including the recess therein, the recess thus defining a space between the swing pipe and the wearing ring, the wearing ring including an outer frontal contact surface extending around other end thereof, the outer frontal contact surface being adapted to be pressed against the center plate in response to pressure within the swing pipe; and an elastic member supported between the swing pipe and the wearing ring within the space defined by the recess, wherein at least one third of the axial length of the elastic member is seated within the recess, the elastic member thus being adapted to seal the space between the wearing ring and the swing pipe, and wherein the elastic member includes a groove formed therein and extending beyond the end of the swing pipe, the groove being adapted to receive fluid and/or other material therein.

30. A tube switch for a double-cylinder sludge pump, comprising:

a swing pipe adapted to swivel in f ront of a center plate, the swing pipe including a recess formed in one end thereof;

a wearing ring supported between the end of the swing pipe and the center plate and axially movable relative to the swing pipe, the wearing ring adapted to receive the end of the swing pipe including the recess therein at one end of the wearing ring, the recess thus defining a space between the swing pipe and the wearing ring, the wearing ring including an outer frontal contact surface at the other end thereof, the outer frontal contact surf ace being adapted to be pressed against the center plate in response to pressure within the swing pipe; and an elastic member supported between the swing pipe and the wearing ring within the space defined by the recess, wherein at least one third of the axial length of the elastic member is seated within the recess, the elastic member thus being adapted to seal the space between the wearing ring and the swing pipe, and wherein the elastic member includes two grooves formed therein, each groove being formed on either end in the axial direction thereof, with one groove extending beyond the end of the swing pipe and being adapted to receive fluid and/or other material therein.

31. A tube switch for a double-cylinder sludge pump, comprising:

a swing pipe adapted to swivel in f ront of a center plate, the swing pipe including a recess formed in one end thereof;

a wearing ring supported between the end of the swing pipe and the center plate and axially movable relative to the swing pipe, the wearing ring adapted to receive the end of the swing pipe including the recess therein at one end of the wearing ring, the recess thus defining a space between the swing pipe and the wearing ring, the wearing ring including an outer frontal contact surface at the other end thereof, the outer frontal contact surface being adapted to be pressed against the center plate in response to pressure within the swing pipe; and an elastic member supported between the swing pipe and the wearing ring within the space defined by the recess, wherein at least one third of the axial length of the elastic member is seated within the recess, the elastic member thus being adapted to seal the space between the wearing ring and the swing pipe, and wherein the elastic member includes a groove formed therein and extending beyond the end of the swing pipe, the groove being adapted to receive fluid and/or other material therein, the groove being defined by a surface facing in a direction substantially away from the swing pipe, the groove thus being adapted to receive pressurized fluid and/or particles therein and, in turn, directing the force of the pressure to push the elastic member to form a seal between the wearing ring and the swing pipe.

32. A tube switch for a sludge pump, comprising:

a center plate supported adjacent to the cylinders of the sludge pump and defining an orifice extending therethrough and in fluid communication with at least one cylinder, the center plate further defining a contact surface extending around the orifice;

a wearing ring supported adjacent to the center plate and defining an opening extending therethrough in fluid communication with the orifice of the center plate, the wearing ring including an outer frontal contact surface on one end thereof, the outer frontal contact surface being adapted to abut the contact surface of the center plate, the wearing ring further including a first annular guide surface at the other end thereof, the wearing ring further defining an inner surf ace oriented in substantially the same plane as the outer frontal contact surface and located adjacent to the interior end of the first annular guide surface;

a swing pipe defining an opening extending therethrough and in fluid communication with the opening in the wearing ring, the swing pipe defining a second annular guide surface, one end of the second annular guide surf ace being adapted to be received within the first annular guide surface of the wearing ring and including a recess formed therein, the recess thus defining a space between the swing pipe and the first annular guide surface of the wearing ring; and an elastic member supported within the space defined by the recess, wherein at least one third of the axial length of the elastic member is seated within the recess, the elastic member thus forming a seal between the first annular guide surface of the wearing ring and the swing pipe, and wherein the elastic member includes a groove formed therein and extending between the recess in the swing pipe and the inner surface of the wearing ring, the groove being adapted to receive pressurized fluid or other pressurized material therein from the swing pipe and, in turn, direct the force of the pressure to push the elastic member to facilitate forming a seal between the first and second annular guide surfaces.

33. A tube switch for a sludge pump, comprising:

a center plate supported adjacent to the cylinders of the sludge pump and defining an orifice extending therethrough and in fluid communication with at least one cylinder, the center plate further defining a contact surface extending around the orifice;

a wearing ring supported adjacent to the center plate and defining an opening extending therethrough in fluid communication with the first orifice of the center plate, the wearing ring including an outer frontal contact surface on one end thereof, the outer frontal contact surface being adapted to abut the contact surface of the center plate, the wearing ring further including a first annular guide surface at the other end thereof, the wearing ring further defining an inner surface oriented in substantially the same plane as the outer frontal contact surface and located adjacent to the interior end of the first annular guide surface;

a swing pipe defining an opening extending therethrough and in fluid communication with the opening of the wearing ring, the swing pipe defining a second annular guide surface, one end of the second annular guide surface being adapted to be received within the first annular guide surface of the wearing ring and including a recess formed therein, the recess thus defining a space between the swing pipe and the first annular guide surface of the wearing ring; and an elastic member supported within the space defined by the recess, wherein at least one third of the axial length of the elastic member is seated within the recess, the elastic member thus forming a seal between the first annular guide surface of the wearing ring and the swing pipe, and wherein the elastic member includes two grooves formed therein, each groove being formed on either end in the axial direction thereof, with one groove extending between the recess in the swing pipe and the inner surface of the wearing ring, the groove being adapted to receive pressurized fluid or other pressurized material therein from the swing pipe and, in turn, direct the force of the pressure to push the elastic member to facilitate forming a seal between the first and second annular guide surfaces.

34. A tube switch for a double-cylinder sludge pump, comprising:

a swing pipe adapted to swivel in f ront of a center plate, the swing pipe including a cylindrical axial guide surface at one end thereof, the swing pipe also including an extension portion having an inner surface;

a wearing ring supported between the end of the swing pipe and the center plate and axially movable relative to the swing pipe, the wearing ring including a recess at one end thereof and a centering surface, the recess being defined by a boundary surface that is inclined relative to the the centering surface, the cylindrical axial guide surface of said swing pipe being adapted to receive the end of the wearing ring including the recess therein and at least a portion of said centering surface, the recess thus defining an annular space between the swing pipe and the wearing ring, the wearing ring including an outer frontal contact surface at the other end thereof being adapted to be pressed against the center plate in response to pressure within the swing pipe, the inner surface of the extension portion of the swing pipe facing the annular space; and an elastic member supported between the swing pipe and the wearing ring within the annular space defined by the recess, the elastic member including a radial inner surface and front and back end surfaces, the front end surface being inclined to correspond to the boundary surface of the wearing ring wherein the front end surface abuts the boundary surface and the back end surface of the elastic member abuts the inner surface of the swing pipe, the elastic member thus being adapted to seal the space between the wearing ring and the swing pipe.

35. A tube switch as defined in claim 34, further comprising a reinforcing ring positioned within said elastic member.

36. A tube switch as defined in claim 35 wherein said reinforcing ring comprises metal.

37. A tube switch as defined in claim 34 wherein the cylindrical axial guide surface and the centering surface define a radial gap therebetween.

38. A tube switch as defined in claim 37 wherein the radial gap has a width of approximately 1 mm.

39. A tube switch as defined in claim 34 wherein the the swing pipe includes a bore extending therethrough and wherein the wearing ring and the swing pipe each include a radial inner surface facing the bore and wherein the radial inner surface of the elastic member faces the bore and is generally aligned with the radial inner surfaces of the wearing ring and the swing pipe.

40. A tube switch as defined in claim 34 wherein the wearing ring is rotatably moveable relative to the swing pipe.

41. A tube switch as defined in claim 34 wherein the inner surface of the extension portion of the swing pipe is ridgeless such that generally no portion of the swing pipe contacts the radial inner surface of the elastic member.

42. A tube switch for a double-cylinder sludge pump, comprising:

a swing pipe adapted to swivel in f ront of a center plate, the swing pipe including a cylindrical axial guide surface at one end thereof, the swing pipe also including an extension portion having an inner surface;

a wearing ring supported between the end of the swing pipe and the center plate and being axially and rotatably movable relative to the swing pipe, the wearing ring including a recess at one end thereof and a centering surface, the recess being defined by a boundary surface that is inclined relative to the the centering surface, the cylindrical axial guide surface of said swing pipe being adapted to receive the end of the wearing ring including the recess therein and at least a portion of said centering surface, the recess thus defining an annular space between the swing pipe and the wearing ring, the wearing ring including an outer frontal contact surface at the other end thereof being adapted to be pressed against the center plate in response to pressure within the swing pipe, the inner surface of the extension portion of the swing pipe facing the annular space; and an elastic member supported between the swing pipe and the wearing ring within the annular space defined by the recess, the elastic member including a radial inner surface and front and back end surfaces, the front end surface being inclined to correspond to the boundary surface of the wearing ring wherein the front end surface abuts the boundary surface and the back end surface of the elastic member abuts the inner surface of the swing pipe, and wherein the inner surface of the extension portion of the swing pipe is ridgeless such that generally no portion of the swing pipe contacts the radial inner surface of the elastic member, the elastic member thus being adapted to seal the space between the wearing ring and the swing pipe.

43. A tube switch as defined in claim 42, further comprising a reinforcing ring positioned within said elastic member.

44. A tube switch as defined in claim 43 wherein said reinforcing ring comprises metal.

45. A tube switch as defined in claim 42 wherein the cylindrical axial guide surface and the centering surface define a radial gap therebetween.

46. A tube switch as defined in claim 45 wherein the radial gap has a width of approximately 1 mm.

47. A tube switch as defined in claim 42 wherein the the swing pipe includes a bore extending therethrough and wherein the wearing ring and the swing pipe each include a radial inner surface facing the bore and wherein the radial inner surface of the elastic member faces the bore and is generally aligned with the radial inner surfaces of the wearing ring and the swing pipe.

48. A tube switch for a double-cylinder sludge pump, comprising:

a swing pipe adapted to swivel in f ront of a center plate, the swing pipe including a cylindrical axial guide surface at one end thereof, the swing pipe also including an extension portion having an inner surface;

a wearing ring supported between the end of the swing pipe and the center plate and axially and rotatably movable relative to the swing pipe, the wearing ring including a centering surface, the wearing ring also including at one end thereof a boundary surface that is inclined relative to the the centering surface, the cylindrical axial guide surface of said swing pipe being adapted to receive the end of the wearing ring including the boundary surface and at least a portion of the centering surface, thus defining an annular space between the swing pipe and the wearing ring, the wearing ring including an outer frontal contact surface at the other end thereof being adapted to be pressed against the center plate in response to pressure within the swing pipe, the inner surface of the extension portion of the swing pipe facing the annular space; and an elastic member supported between the swing pipe and the wearing ring within the annular space, the elastic member including a radial inner surface and front and back end surfaces, the front end surface being inclined to correspond to the boundary surface of the wearing ring wherein the front end surface abuts the boundary surface and the back end surface of the elastic member abuts the inner surface of the swing pipe, and wherein the inner surface of the extension portion of the swing pipe is ridgeless such that generally no portion of the swing pipe contacts the radial inner surface of the elastic member, the elastic member thus being adapted to seal the space between the wearing ring and the swing pipe.

* * * * *